US012704133B2

(12) United States Patent
Suemitsu et al.

(10) Patent No.: US 12,704,133 B2
(45) Date of Patent: Aug. 11, 2026

(54) TURBO COMPRESSOR AND TURBO CHILLER COMPRISING SAME

(71) Applicant: MITSUBISHI HEAVY INDUSTRIES THERMAL SYSTEMS, LTD., Tokyo (JP)

(72) Inventors: Ryosuke Suemitsu, Tokyo (JP); Yusuke Ira, Tokyo (JP); Shintaro Omura, Tokyo (JP); Akimasa Yokoyama, Tokyo (JP); Masaki Shimoide, Tokyo (JP); Takahiro Kono, Tokyo (JP); Yasutaka Aoki, Tokyo (JP); Satoshi Fukahori, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 18/996,634

(22) PCT Filed: Oct. 17, 2022

(86) PCT No.: PCT/JP2022/038506
§ 371 (c)(1),
(2) Date: Jan. 17, 2025

(87) PCT Pub. No.: WO2024/029097
PCT Pub. Date: Feb. 8, 2024

(65) Prior Publication Data

US 2026/0028997 A1 Jan. 29, 2026

(30) Foreign Application Priority Data

Aug. 5, 2022 (JP) ..... 2022-125214

(51) Int. Cl.
*F04D 29/58* (2006.01)
*F04D 17/10* (2006.01)
(Continued)

(52) U.S. Cl.
CPC ..... *F04D 29/582* (2013.01); *F04D 17/10* (2013.01); *F04D 25/06* (2013.01); *F04D 29/058* (2013.01);
(Continued)

(58) Field of Classification Search
CPC ..... F04D 29/058; F04D 17/10; F04D 25/06; F04D 29/5826; F04D 29/584;
(Continued)

(56) References Cited

U.S. PATENT DOCUMENTS

2002/0131877 A1 9/2002 Omori
2007/0132327 A1 6/2007 Brunet
(Continued)

FOREIGN PATENT DOCUMENTS

EP 3940242 A1 * 1/2022 ..... H02K 9/223
JP 3-19499 U 2/1991
(Continued)

OTHER PUBLICATIONS

International Search Report and Written Opinion of the International Searching Authority for International Application No. PCT/JP2022/038506, dated Jan. 10, 2023, with English translation.

*Primary Examiner* — Nathaniel E Wiehe
(74) *Attorney, Agent, or Firm* — Birch, Stewart, Kolasch & Birch, LLP

(57) ABSTRACT

This turbo compressor comprises: an impeller; a shaft part that causes the impeller to rotate; an electric motor that rotatably drives the shaft part; a casing that accommodates the electric motor; a magnetic bearing that supports the shaft part; a heat transfer plate of which one surface is attached to the outer surface of the casing; a magnetic bearing drive substrate that is in surface contact with the other surface of the heat transfer plate on the side opposite from the one surface; and a cooling unit to which a refrigerant is supplied
(Continued)

from the outside, whereby the cold/heat of the supplied refrigerant is transmitted to the heat transfer plate.

7 Claims, 3 Drawing Sheets

(51) Int. Cl.

| | |
|---|---|
| ***F04D 25/06*** | (2006.01) |
| ***F04D 29/058*** | (2006.01) |
| ***F04D 29/42*** | (2006.01) |
| ***F25B 31/02*** | (2006.01) |
| ***F25B 41/31*** | (2021.01) |

(52) U.S. Cl.
CPC ..... *F04D 29/4206* (2013.01); *F25B 31/026* (2013.01); *F25B 41/31* (2021.01)

(58) Field of Classification Search
CPC .... F04D 29/4206; F25B 31/026; F25B 41/31; F25B 41/325; F25B 1/10; F25B 1/053; F16C 32/04
See application file for complete search history.

(56) References Cited

U.S. PATENT DOCUMENTS

| | | | | |
|---|---|---|---|---|
| 2018/0231006 | A1* | 8/2018 | Sun | F04D 25/06 |
| 2019/0195240 | A1* | 6/2019 | Iizuka | H02K 5/18 |

FOREIGN PATENT DOCUMENTS

| | | | | |
|---|---|---|---|---|
| JP | 2002-276587 | A | 9/2002 | |
| JP | 2007-508492 | A | 4/2007 | |
| JP | 2021-156220 | A | 10/2021 | |
| WO | WO-2014084989 | A2 * | 6/2014 | F04D 25/06 |

* cited by examiner

TURBO COMPRESSOR AND TURBO CHILLER COMPRISING SAME

TECHNICAL FIELD

The present disclosure relates to a turbo compressor and a centrifugal chiller including the same.

This application claims priority to Japanese Patent Application No. 2022-125214, filed in Japan on Aug. 5, 2022, the content of which is incorporated herein by reference.

BACKGROUND ART

For example, PTL 1 discloses a turbo compressor including a magnetic bearing drive substrate that drives a magnetic bearing supporting a shaft, portion. This magnetic bearing drive substrate is attached to a casing of a turbo compressor. As a result of cooling the casing by guiding the refrigerant for cooling into the casing. the magnetic bearing drive substrate is cooled.

CITATION LIST

Patent Literature

[PTL 1] Japanese Unexamined Patent Application Publication No. 2021-156220

SUMMARY OF INVENTION

Technical Problem

Meanwhile, the casing described in the PTL 1 is made of metal such as an aluminum-based alloy, and the casing functions as a heat sink for cooling the magnetic bearing drive substrate. In a case where the entire casing is formed of a metal such an aluminum-based alloy in order to cool the magnetic bearing drive substrate, the cost may increase as compared with a case where the casing is formed of a metal material such as iron. In addition, the temperature of the casing changes in accordance with the load on the turbo compressor, and the amount of heat generated by the magnetic bearing drive substrate changes. Therefore, it may be difficult to stably cool the magnetic bearing drive sub The present disclosure bas been made to solve the above-described problems, and an object of the present disclosure is to provide a turbo compressor and a centrifugal chiller capable of stably cooling a magnetic bearing drive substrate while suppressing an increase in cost.

Solution to Problem

In order to solve the above problem, a turbo compressor according to the present disclosure includes: an impeller; a shaft portion that rotates the impeller, an electric motor that rotationally drives the shaft portion; a casing that accommodates the electric motor; a magnetic bearing that supports the shaft portion; a heat transfer plate of which one surface is attached to an outer surface of the casing; a magnetic bearing drive substrate that is in surface contact with the other surface of the heat transfer plate opposite to the one surface of the heat transfer plate; and a cooling section that, by being supplied with a refrigerant from an outside, transfers cold of the supplied refrigerant to the heat transfer plate.

A centrifugal chiller according to the present disclosure includes: the abo turbo compressor; a condenser that condenses a refrigerant discharged from the turbo compressor; an expansion valve that expands the refrigerant condensed by the condenser; an evaporator that evaporates the refrigerant adiabatically expanded by the expansion valve; and a refrigerant supply unit that is capable of introducing the refrigerant condensed by the condenser to the cooling section.

Advantageous Effects of Invention

According to the present disclosure, it is possible to provide a turbo compressor and a centrifugal chiller capable of stably cooling a magnetic bearing drive substrate while suppressing an increase in cost.

DESCRIPTION OF EMBODIMENTS

Hereinafter, an embodiment of a centrifugal chiller including the turbo compressor according to the present disclosure will be described with reference to the accompanying drawings.

The centrifugal chiller is a device that is provided in an air conditioning apparatus of a factory, a large-scale facility, or the like and is operated as a heat source machine. As the refrigerant used in the centrifugal chiller, a hydrofluoroolefin (HFO)-based refrigerant having a relatively small global warming potential (GWP) or a hydrofluorocarbon (HFC)-based refrigerant is used. Specific examples of the refrigerant include HPO-1233zd (E), HFO-1234ze (E), and HFC-134a.

Figure 1:
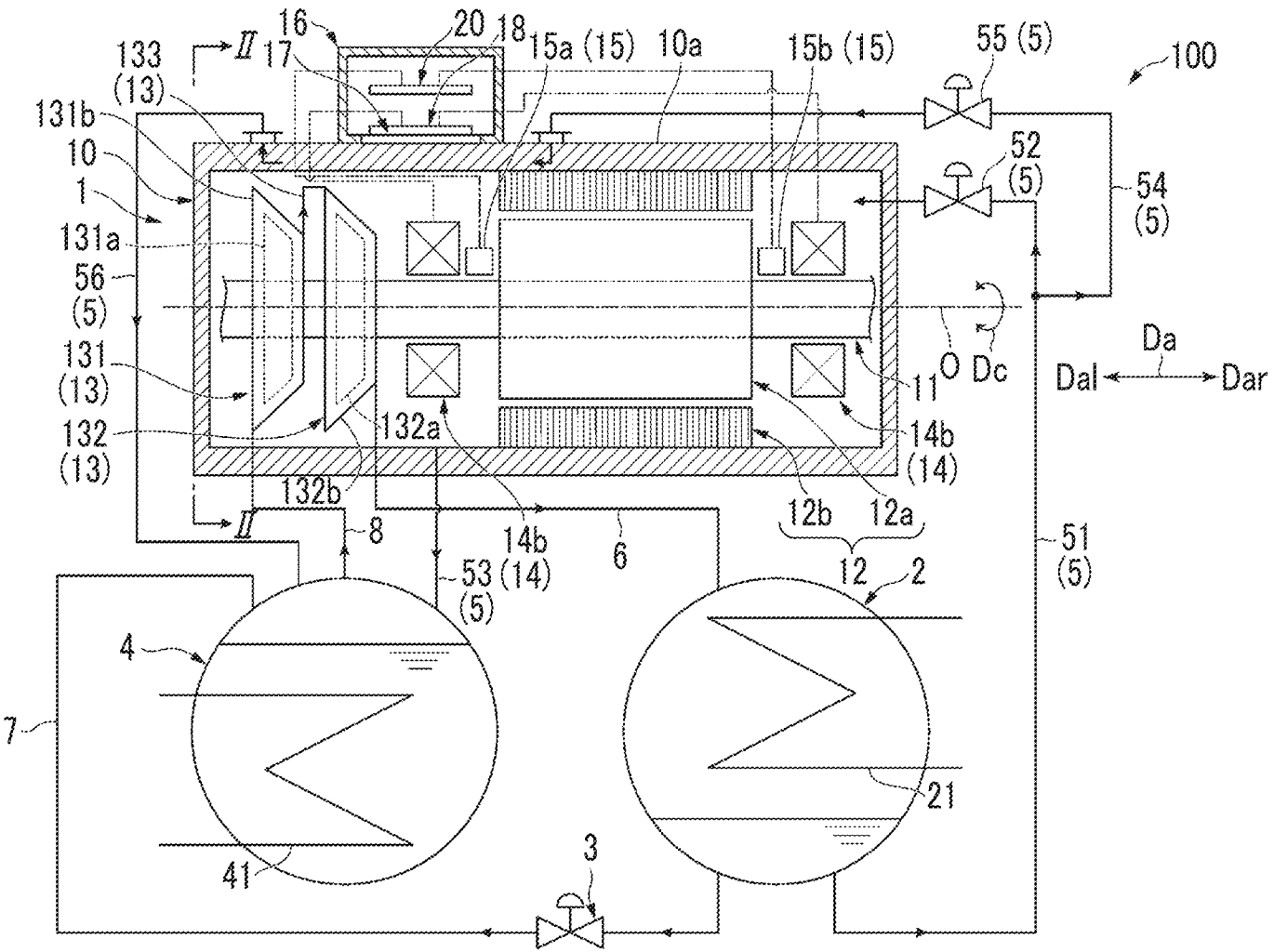
FIG. 1 is a system diagram for explaining a configuration of a centrifugal chiller according to an embodiment of the present disclosure.

As shown in FIG. 1. the centrifugal chiller 100 according to the present embodiment includes a turbo compressor 1, a condenser 2, an expansion valve 3, an evaporator 4, a refrigerant supply unit 5, a condenser line 6, a connection line 7, and an evaporator line 8.

Turbo Compressor

The turbo compressor 1 is a device that compresses the inhaled refrigerant to a predetermined high pressure and discharges the refrigerant by applying kinetic energy to the refrigerant by a centrifugal force of an impeller.

Figure 2:
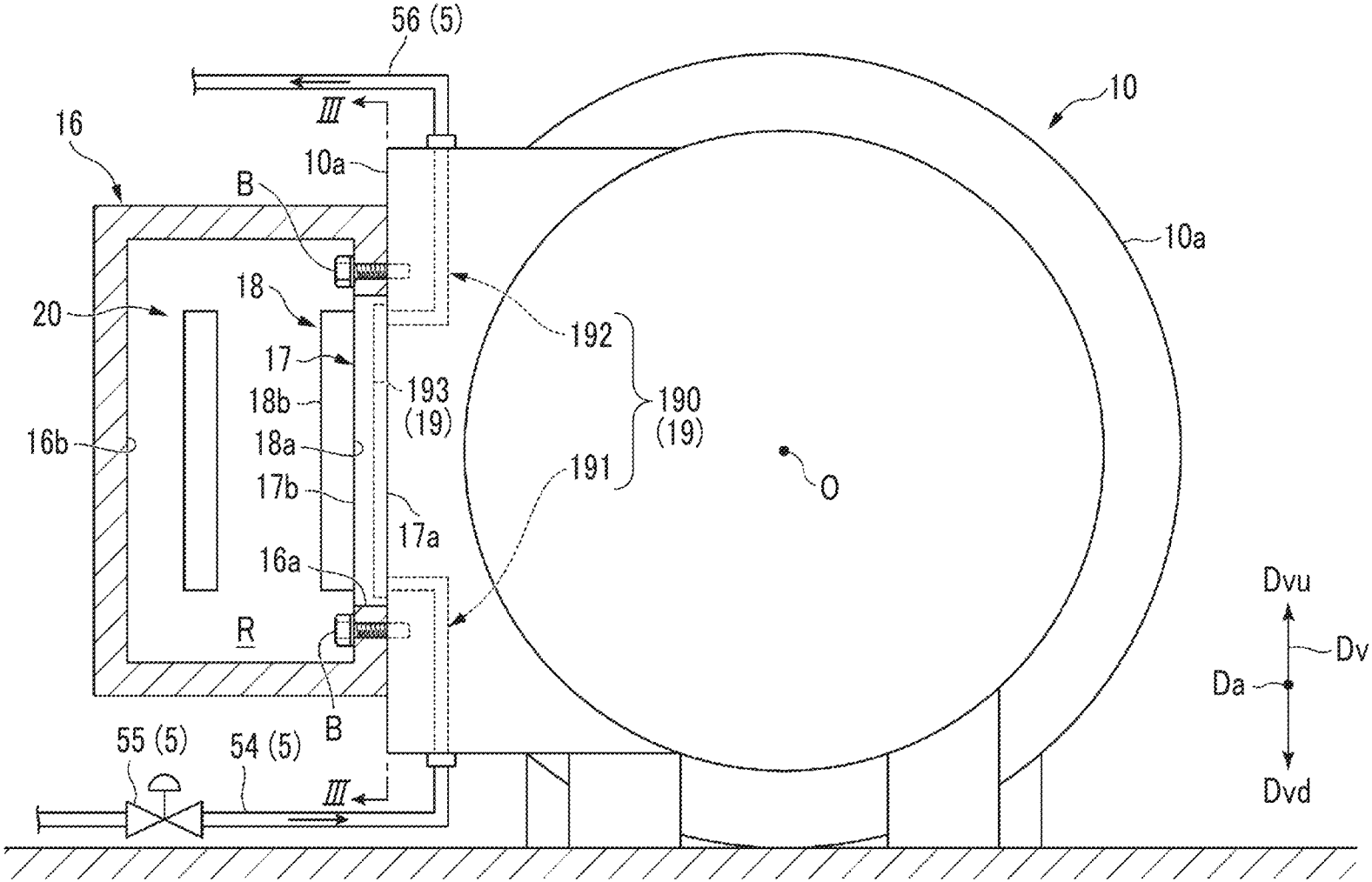
FIG. 2 is a diagram showing a configuration in a box and a configuration of a cooling section in a case where the turbo compressor is viewed from the direction along the line II-II in FIG. 1.

The turbo compressor 1 according to the present embodiment includes a casing 10, a shaft portion 11, an electric motor 12, an impeller 13, a magnetic bearing 14, a displacement sensor 15, a box 16, a beat transfer plate 17, a magnetic bearing drive substrate 18, a displacement sensor substrate 20, and a cooling section 19 (see FIG. 2).

Casing

The casing 10 forms an outer shell of the turbo compressor 1. The casing 10 accommodates various devices constituting the turbo compressor 1. The casing 10 has, for example, a tubular shape in which both ends are closed in a state of being extended in one direction.

The casing 10 has an outer surface 10*a* exposed to the atmosphere. The casing 10 is fixed to a floor surface such as a ground or a frame. The casing 10 according to the present embodiment is formed of, for example, a metal material containing iron.

Shaft Portion

The shaft portion 11 is a rotating shaft that has a cylindrical shape extending in a direction in which a central axis O extends centered on the central axis O as a virtual axis. For convenience of description, a direction in which the central axis O, on which the shaft portion 11 is centered, extends will be referred to as an "axial direction Da". The axial direction Da matches the one direction, which is the direction in which the casing 10 extends. In addition, among both sides in the axial direction Da, one side (right side in FIG. 1) is simply referred to as a "one side Dar", and the opposite side (left side in FIG. 1) is referred to as an "other side Dal".

In addition, the circumferential direction with respect to the central axis O (or the shaft portion 11) will be simply referred to as a "circumferential direction De". In addition, a direction perpendicular to the central axis O is referred to as a "radial direction". The shaft portion 11 is accommodated in the casing 10. The shaft portion 11 in the present embodiment is made of, for example, a metal material containing iron or the like.

Electric Motor

The electric motor 12 is a device that rotationally drives the shaft portion 11 about the central axis O by using an electromagnetic force generated by power input. The electric motor 12 is accommodated in the casing 10.

The electric motor 12 includes a motor rotor 12*a* and a motor stator 12*b*.

The motor rotor 12*a* is rotatable about the central axis O together with the shaft portion 11 and is a rotor of the electric motor 12. The motor rotor 12*a* is attached to the shaft portion 11 so as to cover the shaft portion 11 from the outer peripheral side in a state of forming a cylindrical shape, in an integrated manner.

The motor stator 12*b* is driven to rotate the motor rotor 12*a*. That is, the motor stator 12*b* is a stator with respect to the rotor (motor rotor 12*a*). The motor stator 12*b* is attached to an inner surface of the casing 10 so as to cover the motor rotor 12*a* from the outer peripheral side in a state of forming a cylindrical shape. An inner peripheral surface of the motor stator 12*b* faces the outer peripheral surface of the motor rotor 12*a* in the radial direction through a clearance in a case where the electric motor 12 is driven.

The motor stator 12*b* is electrically connected to, for example, an inverter device (not shown), such as a variable frequency drive (VFD) disposed outside the casing 10, and is driven under control of the inverter device. By applying a three-phase alternating current voltage from the inverter device to a coil provided in the motor stator 12*b*, an electromagnetic force for rotating the motor rotor 12*a* around the central axis O is generated.

Impeller

The impeller 13 rotates together with the shaft portion 11 to compress a refrigerant in a gaseous state supplied from the outside of the turbo compressor 1 and to discharge the compressed refrigerant. The impeller 13 is accommodated in the casing 10. The impeller 13 is disposed on the other side Dal with respect to the electric motor 12, The impeller 13 according to the present embodiment has two impellers 131 and 132 attached to the shaft portion 11 in a state of being spaced apart from each other in the axial direction Da, and an interstage line 133 that connects the two impellers 131 and 132 to each other.

Hereinafter, for convenience of description, in the two impellers 131 and 132 provided in the impeller 13, the impeller disposed on the other side Dal is referred to as a "first impeller 131", and the impeller disposed on the one side Dar with respect to the first impeller 131 is referred to as a "second impeller 132".

The first impeller 131 increases the pressure of the refrigerant supplied from the outside of the turbo compressor 1 to a predetermined first pressure value, The first impeller 131 includes a first blade group 131*a* consisting of a plurality of blades (vanes) arranged in the circumferential direction De of the shaft portion 11 in a case where the first impeller 131 is fixed to the shaft portion 11, and a first impeller casing 131*b* that forms a compression path inside together with the first blade group 131*a* in a state of covering the first blade group 131*a* from an outer peripheral side of the shaft portion 11. The first impeller casing 1316 is formed with a first refrigerant introduction port for introducing the refrigerant from the outside into the compression path and a first refrigerant discharge port for discharging the compressed refrigerant from the compression path to the outside, The second impeller 132 increases the pressure of the refrigerant compressed by the first impeller 131 to a predetermined second pressure value higher than the first pressure value.

The second impeller 132 includes a second blade group 132*a* consisting of a plurality of blades (vanes) arranged in the circumferential direction De of the shaft portion 11 in a case where the second impeller 132 is fixed to the shaft portion 11, and a second impeller casing 132*b* that forms a compression path inside together with the second blade group 132*a* in a state of covering the second blade group 132*a* from an outer peripheral side of the shaft portion 11. The second impeller casing 132*b* is formed with a second refrigerant introduction port for introducing a refrigerant from the outside into the compression path and a second refrigerant discharge port for discharging the compressed refrigerant from the compression path to the outside.

The first refrigerant discharge port of the first impeller 131 and the second refrigerant introduction port of the second impeller 132 are connected to each other such that the refrigerant can be circulated by an interstage line 133.

Therefore, the refrigerant introduced into the compression path of the first impeller 131 from the outside through the first refrigerant introduction port of the first impeller 131 is compressed by the first blade group 131*a* that rotates around the central axis O in the compression path with the rotation of the shaft portion 11, and then flows into the interstage line 133 through the first refrigerant discharge port. The refrigerant that has flowed into the interstage line 133 flows into the compression path of the second impeller 132 through the second refrigerant introduction port of the second impeller 132 and is compressed by the second blade group 132*a* in the compression path. The refrigerant compressed in the compression path of the second impeller 132 is discharged to the outside through the second refrigerant discharge port of the second impeller 132.

That is, the impeller 13 having the first impeller 131 and the second impeller 132 constitutes a two-stage compression mechanism in the turbo compressor 1.

Magnetic Bearing

The magnetic bearing 14 is a radial magnetic bearing that supports the shaft portion 11 to be rotatable by magnetically levitating the shaft portion. 11. The magnetic bearing 14 is accommodated in the casing 10.

The magnetic bearing 14 according to the present embodiment is configured with a first magnetic bearing 14*a* and a second magnetic bearing 14*b* that are disposed to interpose the electric motor 12 in a state of being spaced apart from each other in the axial direction Da.

The first magnetic bearing 14*a* and the second magnetic bearing 14*b* support the shaft portion 11 in the radial direction (the radial direction of the shaft portion 11) with respect to the central axis O. The first magnetic bearing 14*a* and the second magnetic bearing 14*b* cover the shaft portion 11 from the outer peripheral side.

The first magnetic bearing 14*a* is disposed, for example, between the electric motor 12 and the second impeller 132 of the impeller 13. An inner surface of the first magnetic bearing 14*a* faces an outer peripheral surface of the shaft portion 11 in the radial direction of the central axis O with a clearance therebetween.

The first magnetic bearing 14*a* is electrically connected to a magnetic bearing drive substrate 18 disposed outside the casing 10. By applying a three-phase alternating current voltage from the magnetic bearing drive substrate 18 to a coil of the first magnetic bearing 14*a* (by driving the first magnetic bearing 14*a*), an electromagnetic force for magnetically levitating the shaft portion 11 in a non-contact state with respect to the first magnetic bearing 14*a* is generated.

The second magnetic bearing 14*b* is disposed on the one side Dar with respect to the electric motor 12. An inner surface of the second magnetic bearing 14*b* faces an outer peripheral surface of the shaft portion 11 in a radial direction of the central axis O with a clearance therebetween.

The second magnetic bearing 14*b* is electrically connected to the magnetic bearing drive substrate 18 in the same manner as the first magnetic bearing 14*a*. By applying a three-phase alternating current voltage from the magnetic bearing drive substrate 18 to the coil of the second magnetic bearing 14*b* (by driving the second magnetic bearing 14*b*), an electromagnetic force for magnetically levitating the shaft portion 11 in a non-contact state with respect to the second magnetic bearing 14*b* is generated.

It should be noted that, although detailed illustration is omitted, for example, a flange portion that is formed integrally with the shaft portion 11 and that spreads in a disk shape in a radial direction from the shaft portion 11 may be formed on the one side Dar with respect to the second magnetic bearing 14*b*, and a thrust magnetic bearing that supports the flange portion in a state of interposing the flange portion from the axial direction Da and positions the shaft portion 11 in the axial direction Da (thrust direction of the shaft portion 11) may be disposed.

Displacement Sensor

The displacement sensor 15 detects the magnitude of the clearance formed between the shaft portion 11 and the magnetic bearing 14 in the radial direction in a case where the magnetic bearing 14 is driven. The displacement sensor 15 is accommodated in the casing 10.

The displacement sensor 15 according to the present embodiment is configured with a first displacement sensor 15*a* and a second displacement sensor 15*b* that are disposed to interpose the electric motor 12 in a state of being spaced apart from each other in the axial direction Da. The first displacement sensor 15*a* and the second displacement sensor 15*b* are electrically connected to a displacement sensor substrate 20 disposed outside the casing 10.

The first displacement sensor 15*a*detects the magnitude of the clearance between the shaft portion 11 and the first magnetic bearing 14*a*. The second displacement sensor 15*b* detects the magnitude of the clearance between the shaft portion 11 and the second magnetic bearing 14*b*. The first displacement sensor 15*a* and the second di isp sensor 15*b* transmit signals indicating the detected magnitudes of the clearances to the displacement sensor substrate 20.

Box

The box 16 is a box (casing) that accommodates the magnetic bearing drive substrate 18 for driving the magnetic bearing 14 and the displacement sensor substrate 20 that processes the detection result received from the displacement sensor 15. As shown in FIGS. 1 and 2, the box 16 according to the present embodiment is attached to the outer surface 10*a* of the casing 10.

Specifically, as shown in FIG. 2, of the outer surface 10*a* of the casing 10, the box 16 is attached to the outer surface 10*a* which is in parallel with a virtual plane that can be defined by an up-down direction Dv and the axial direction Da.

The up-down direction Dv in the present specification is aligned with a vertical direction. In addition, in the both sides in the up-down direction Dv, a side on which the gravity acts (lower side in FIG. 2 and FIG. 3) is referred to as a "lower side Dvd", and an opposite side (upper side in FIG. 2 and FIG. 3) is referred to as an "upper side Dvu", In addition, the box 16 has a rectangular parallelepiped shape in which a rectangular opening 16*a* is formed on one surface. The box 16 is fixed to the outer surface 10*a* of the casing 10 by a fastening member B such as a bolt in a state where the opening 16*a* faces the outer surface 10*a* of the casing 10.

The box 16 can be detached from the casing 10 by detaching the fastening member B. That is, the box 16 is attached to the casing 10 so as to be attachable to and detachable from the casing 10. The box 16 according to the present embodiment is formed of, for example, a metal material containing aluminum.

Heat Transfer Plate

The heat transfer plate 17 is a metal plate for cooling the magnetic bearing drive substrate 18 accommodated in the box 16. The heat transfer plate 17 is formed in a flat plate shape that forms a rectangle The heat transfer plate 17 is fitted without a gap in the opening 16*a* of the box 16. The heat transfer plate 17 is fitted to the opening 16*a* of the box 16 to form a closed space in the box 16 that is airtightly separated from the outside. For convenience of description, the space in the box 16 that is the closed space will be referred to as an "accommodation space R".

The heat transfer plate 17 has one surface 17*a* that comes into contact with the outer surface 10*a* of the casing 10 and another surface 17*b* facing the side opposite to the one surface 17*a* in a case where the heat transfer plate 17 is attached to the outer surface 10*a* of the casing 10.

One surface 17*a* of the heat transfer plate 17 is fixed to the outer surface 10*a* of the casing 10 in a state of being directly in surface contact with the outer surface 10*a*. The other surface 17*b* of the heat transfer plate 17 faces the accommodation space R side. The heat transfer plate 17 according to the present embodiment is formed of, for example, a metal material containing aluminum.

Magnetic Bearing Drive Substrate

The magnetic bearing drive substrate 18 is a magnetic bearing controller substrate (MBC) for inputting power for driving the magnetic bearing 14 (the first magnetic bearing 14*a* and the second magnetic bearing 14*b*). The magnetic bearing drive substrate 18 is accommodated in the box 16. That is, the magnetic bearing drive substrate 18 is disposed in the accommodation space R. The magnetic bearing drive substrate 18 has a flat plate shape. The magnetic bearing drive substrate 18 is attached to the heat transfer plate 17.

The magnetic bearing drive substrate 18 has an abutting surface 18*a* that comes into surface contact with the other surface 17*b* of the heat transfer plate 17 and a mounting surface 18*b* that faces a side opposite to the abutting surface 18*a* and on which various circuit elements are mounted.

The wiring line electrically connecting the magnetic bearing drive substrate 18 and the magnetic bearing 14 extends from the magnetic bearing drive substrate 18 to the outside of the box 16 so as to penetrate the side wall of the box 16 so that the airtightness of the accommodation space R in the box 16 is ensured. The extended end reaches each of the first magnetic bearing 14*a* and the second magnetic bearing 14*b* disposed in the casing 10.

Displacement Sensor Substrate

The displacement sensor substrate 20 receives a signal indicating a detection result (a magnitude of the clearance) transmitted from the displacement sensor 15 (the first displacement sensor 15*a* and the second displacement sensor 15*b*), and is a circuit board for processing the detection result.

The displacement sensor substrate 20 is accommodated in the box 16 together with the magnetic bearing drive substrate 18. That is, the displacement sensor substrate 20 is disposed in the accommodation space R. The displacement sensor IS is attached to, for example, an inner surface 16*b* of the box 16 and is supported by the inner surface 16*b*. The displacement sensor substrate 20 according to the present embodiment is not in contact with the heat transfer plate 17.

In order to ensure the airtightness of the accommodation space R in the box 16, the wiring line that electrically connects the displacement sensor substrate 20 and the displacement sensor 15 extends from the displacement sensor substrate 20 to the outside of the box 16 so as to penetrate the side wall of the box 16. The extended end reaches each of the first displacement sensor 15*a* and the second displacement sensor 15*b* disposed in the casing 10.

Here, the accommodation space R in the box 16 is replaced with an inert gas. Specifically, for example, the gas replacement device (not shown) provided in the box 16 is driven to replace the air in the accommodation space R with nitrogen gas. Therefore, the magnetic bearing drive substrate 18 and the displacement sensor substrate 20 accommodated in the box 16 are in an inert gas atmosphere.

As the inert gas in the present embodiment, for example, a nitrogen gas ($N_2$) or the like can be employed. The "replaced with an inert gas" described herein refers to a state in which the atmosphere in the accommodation space R is substantially replaced with an inert gas, and it is allowed that a small amount of air is included in the atmosphere in the accommodation space R.

Cooling Section

By supplying the refrigerant from the outside, the cooling section 19 transfer the cold of the supplied refrigerant to the heat transfer plate 17.

As shown in FIG. 2, the cooling section 19 according to the present embodiment has a flow path portion 190 and a groove portion 193 formed in the heat transfer plate 17.

The flow path portion 190 is formed in the outer wall of the casing 10.

The flow path portion 190 is configured with a first flow path portion 191 that circulates the refrigerant introduced from the outside of the casing 10 and guides the refrigerant to the groove portion 193, and a second flow path portion 192 that circulates the refrigerant flowing out from the groove portion 193 and guides the refrigerant to the outside of the casing 10.

The first flow path portion 191 and the second flow path portion 192 extend in the outer wall of the casing 10 and do not communicate with the inner space of the casing 10. One end of the first flow path portion 191 is opened to an outer surface 10*a* different from the outer surface 10*a* of the casing 10 in contact with the one surface 17*a* of the heat transfer plate 17. The other end of the first flow path portion 191 is connected to the groove portion 193.

One end of the second flow path portion 192 is opened to an outer surface 10*a* different from the outer surface 10*a* of the casing 10 in contact with the one surface 17*a* of the heat transfer plate 17. The other end of the second flow path portion 192 is connected to the groove portion 193.

Figure 3:
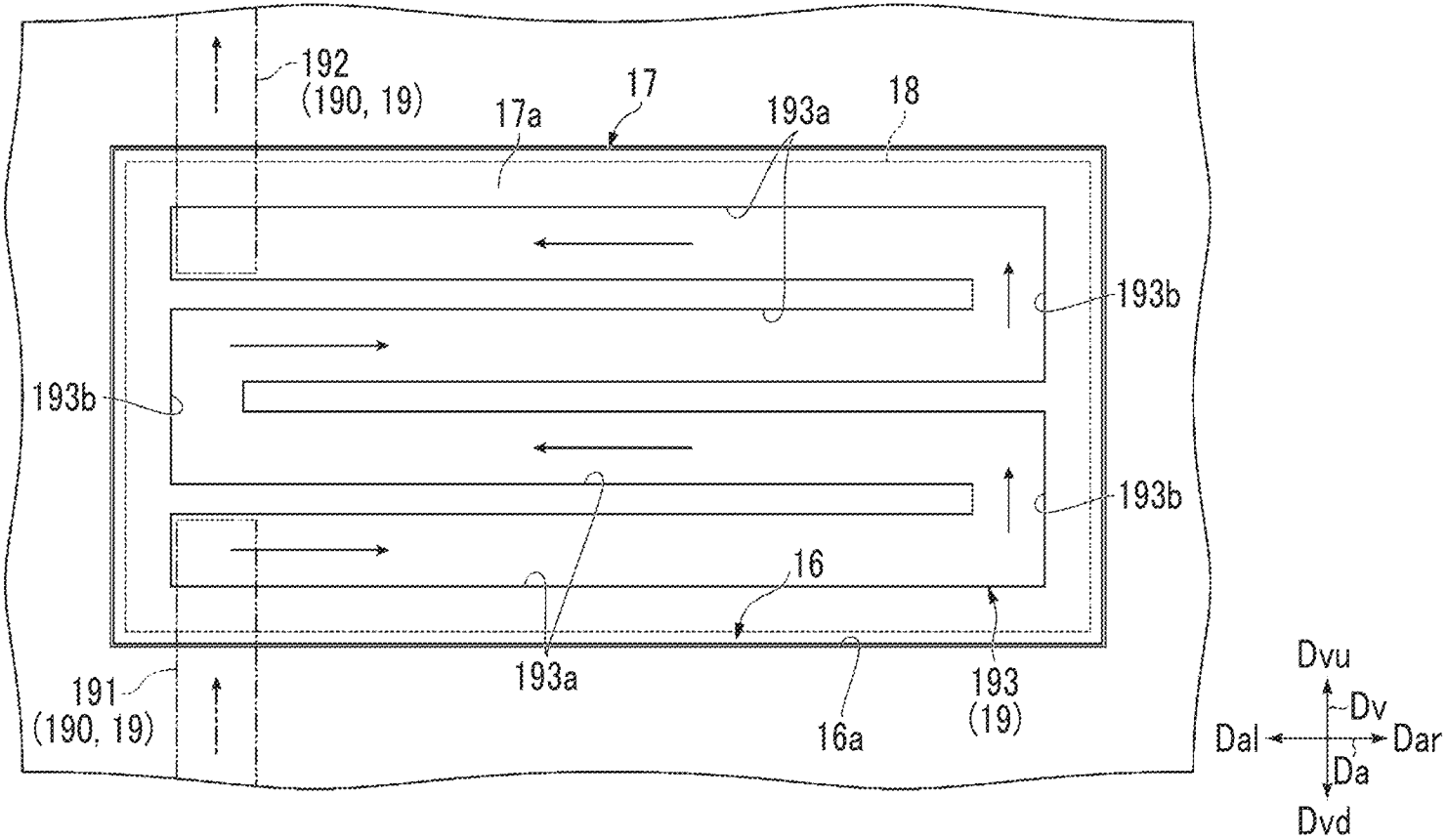
FIG. 3 is a diagram showing a configuration of a groove portion in a case where one surface of a heat transfer plate is viewed from the direction along the line III-III in FIG. 2.

The groove portion 193 is a recessed portion formed in the heat transfer plate 17. The groove portion 193 is recessed from one surface 17*a* to the other surface 17*b* of the heat transfer plate 17. The groove portion 193 is recessed from the one surface 17*a* toward the other surface 17*b* to form a flow path for circulating the refrigerant together with the outer surface 10*a* of the casing 10, which is in contact with the one surface 17*a* of the heat transfer plate 17. As shown in FIG. 3, the groove portions 193 in the present embodiment extend along the one surface 17*a* of the heat transfer plate 17 in a meandering manner.

Specifically, the groove portion 193 is configured with a plurality of extension grooves 193*a* extending in the axial direction Da and a plurality of connection grooves 193*b* extending in the up-down direction Dv in a case where the heat transfer plate 17 is attached to the outer surface 10*a* of the casing 10. By connecting the extension grooves 193*a* and the connection grooves 193*b* to each other so as to be alternately repeated, the groove portion 193 that meanders along the one surface 17*a* of the heat transfer plate 17 is configured.

Therefore, the refrigerant that has flowed into the groove portion 193 flows along the one surface 17*a* of the heat transfer plate 17 while meandering. In the present embodiment, the four extension grooves 193*a* are arranged at equal intervals in the up-down direction Dv in a state of being along the one surface 17*a* of the heat transfer plate 17, and the three connection grooves 193*b* connect the end portions of the four extension grooves 193*a*, adjacent to each other in the up-down direction Dv in the axial direction Da, to each other in the up-down direction Dv. The width dimension (dimension in the up-down direction Dv) of the extension groove 193*a* and the width dimension (dimension in the axial direction Da) of the connection groove 193*b* are the same as each other.

Here, the other end of the first flow path portion 191 is connected to an end portion of the other side Dal (left side in FIG. 3) which is a side of the extension groove 193*a* disposed on the most lower side Dvd and to which the connection groove 193*b* is not connected.

The other end of the second flow path portion 192 is connected to an end portion on the one side Dar (left side in FIG. 3) which is a side where the extension groove 193*a* disposed on the most upper side Dve and to which the connection groove 193*b* is not connected.

Condenser

The condenser 2 receives the refrigerant in a gaseous stare discharged from the impeller 13 of the turbo compressor 1 and is a heat exchanger that condenses the refrigerant. As shown in FIG. 1, the condenser 2 is disposed outside the turbo compressor 1.

Here, the condenser 2 and the turbo compressor 1 are connected by a condenser line 6. The condenser line 6 according to the present embodiment is a connection pipe through which the refrigerant circulates. Specifically, one end of the condenser line 6 is connected to the refrigerant discharge port of the second impeller 132 in the impeller 13, and the other end of the condenser line 6 is connected to the refrigerant introduction port of the condenser 2. Therefore, the refrigerant compressed by the impeller 13 of the turbo compressor 1 is guided into the condenser 2 through the condenser line 6.

A heat transfer pipe 21 through which cooling water for cooling the refrigerant flows is inserted into the condenser 2. The cooling water flowing through the beat transfer pipe 21 is heated by being subjected to heat exchange with the refrigerant in the condenser 2 through the heat transfer pipe 21. The heated cooling water flows through the heat transfer pipe 21 toward the outside of the condenser 2 and is introduced into a cooling tower or the like (not shown) provided outside the centrifugal chiller 100 to be cooled (heat is exhausted). The cooling water cooled outside the condenser 2 flows into the heat transfer pipe 21 again, flows through the heat transfer pipe 21 toward the condenser 2, and exchanges heat with the refrigerant again in the condenser 2.

The refrigerant cooled by heat exchange in the condenser 2 is condensed and becomes a liquid state. The refrigerant in the liquid state is stored in the condenser 2. The temperature of the refrigerant in the liquid state stored in the condenser 2 is, for example, in a range of 35° C. to 45° C.

The refrigerant in the liquid state stored in the condenser 2 flows toward the evaporator 4 through a connection line 7 that connects the condenser 2 and the evaporator 4 to each other. The connection line 7 according to the present embodiment is a connection pipe through which the refrigerant circulates. Specifically, one end of the connection line 7 is connected to the refrigerant discharge port of the condenser 2, and the other end of the connection line 7 is connected to the refrigerant introduction port of the evaporator 4.

Expansion Valve

The expansion valve 3 expands the refrigerant in the liquid state flowing from the condenser 2 through the connection line 7 in an adiabatic manner to decrease the pressure and the temperature of the refrigerant flowing through the connection line 7. The expansion valve 3 is provided on the connection line 7. Therefore, the refrigerant that is adiabatically expanded by the expansion valve 3 is guided to the evaporator 4 through the connection line 7. The refrigerant flowing through the connection line 7 from the expansion valve 3 to the evaporator 4 is in a liquid state.

Evaporator

The evaporator 4 is a heat exchanger that receives and stores the refrigerant in a liquid state adiabatically expanded by the expansion valve 3 and evaporates the stored refrigerant. The evaporator 4 is disposed outside the turbo compressor 1.

Here, the evaporator 4 and the turbo compressor 1 are connected by an evaporator line 8. The evaporator line 8 according to the present embodiment is a connection pipe through which the refrigerant circulates. Specifically, one end of the evaporator line 8 is connected to the refrigerant discharge port of the evaporator 4, and the other end of the evaporator line 8 is connected to the refrigerant introduction port of the first impeller 131 in the impeller 13. Therefore, the refrigerant that is evaporated in the evaporator 4 and is in a gaseous state is guided to the turbo compressor 1 through the evaporator line 8.

A heat transfer pipe 41 through which a heat medium for heating the refrigerant flows is inserted into the evaporator 4. Examples of the heat medium flowing through the heat transfer pipe 41 include chilled water introduced from a device outside the centrifugal chiller 100. The heat medium flowing through the heat transfer pipe 41 is cooled by being subjected to heat exchange with the refrigerant in the evaporator 4 through the heat transfer pipe 41. The cooled heat medium flows through the heat transfer pipe 41 toward the outside of the evaporator 4 and is introduced into a device (not shown) provided outside the centrifugal chiller 100 to be bested (to be recovered as the cold). The heat medium heated by the device outside the evaporator 4 flows into the heat transfer pipe 41 again, and flows through the heat transfer pipe 41 toward the evaporator 4 to perform heat exchange with the refrigerant again in the evaporator 4.

The refrigerant heated by heat exchange in the evaporator 4 evaporates and becomes a gaseous state. The refrigerant in a gaseous state is guided to the turbo compressor 1 through the evaporator line 8. The temperature of the refrigerant in the liquid state stored in the evaporator 4 is, for example, in a range of 0° C. to 10° C.

Refrigerant Supply Unit

The refrigerant supply unit 5 takes out a part of the refrigerant stored in the condenser 2 in a liquid state as a heat medium for cooling and supplies the refrigerant to the turbo compressor 1.

The refrigerant supply unit 5 according to the present embodiment includes a first introduction line 51, a first adjustment valve 52, a first discharge line 53, a second introduction line 54, a second adjustment valve 55, and a second discharge line 56.

First Introduction Line

The first introduction line 51 is a pipe that connects the condenser 2 and the casing 10 of the turbo compressor 1 to each other. Specifically, one end of the first introduction line 51 is connected to the refrigerant discharge port of the condenser 2, and the other end of the first introduction line 51 is connected to the refrigerant introduction port formed in the casing 10. Therefore, the refrigerant in the liquid state stored in the condenser 2 flows toward the inside of the casing 10 through the first introduction line 51.

First Adjustment Valve

The first adjustment valve 52 decompresses the refrigerant in a liquid state flowing from the condenser 2 through the first introduction line 51 to reduce the pressure and the temperature of the refrigerant flowing through the first introduction line 51. The first adjustment valve 52 according to the present embodiment is a pressure adjustment valve. The first adjustment valve 52 is provided on the first introduction line 51.

The first adjustment valve 52 decompresses the refrigerant flowing through the first introduction line 51 to transition (change in state) the refrigerant from the liquid state to a gas-liquid two-phase state. The refrigerant in the gas-liquid two-phase state that has passed through the first adjustment valve 52 is guided into the casing 10 of the turbo compressor 1 through the first introduction line 51.

First Discharge Line

The first discharge line 53 is a pipe that connects the casing 10 of the turbo compressor 1 and the evaporator 4 to each other. Specifically, one end of the first discharge line 53 is connected to the refrigerant discharge port formed in the casing 10, and the other end of the first discharge line 53 is connected to the refrigerant introduction port of the evaporator 4.

The refrigerant introduced into the casing 10 through the first introduction line 51 cools various devices accommodated in the casing 10 and is then guided to the evaporator 4 through the first discharge line 53. The refrigerant guided into the casing 10 mainly cools the electric motor 12, the magnetic bearing 14, and the casing 10.

Second Introduction Line

The second introduction line 54 is a pipe that connects the first introduction line 51 and the cooling section 19 of the turbo compressor 1 to each other. Specifically, as shown in FIGS. 1 and 2, one end of the second introduction line 54 is connected to a portion of the first introduction line 51 on the condenser 2 side of the first adjustment valve 52. The other end of the second introduction line 54 is connected to the above-described one end of the first flow path portion 191 in the cooling section 19. The refrigerant in the liquid state stored in the condenser 2 flows toward the first flow path portion 191 through the second introduction line 54 connected to branch from the first introduction line 51.

Second Adjustment Valve

The second adjustment valve 55 decompresses the refrigerant flowing through the second introduction line 54 in a liquid state to reduce the pressure and the temperature of the refrigerant flowing through the second introduction line 54, The second adjustment valve 55 in the present embodiment is a pressure adjustment valve. The second adjustment valve 55 is provided in the second introduction fine 54.

The second adjustment valve 55 decompresses the refrigerant flowing through the second introduction line 54 to transition (change in state) the refrigerant from the liquid state to the gas-liquid two-phase state. The refrigerant in the gas-liquid two-phase state after passing through the second adjustment valve 55 is guided into the first flow path portion 191 of the cooling section 19 through the second introduction line 54.

Second Discharge Line

The second discharge line 56 is a pipe that connects the second flow path portion 192 of the cooling section 19 and the evaporator 4 to each other. Specifically, one end of the second discharge line 56 is connected to the one end of the second flow path portion 192, and the other end of the second discharge line 56 is connected to the refrigerant introduction port of the evaporator 4.

The refrigerant introduced into the first flow path portion 191 through the second introduction line 54 flows through the groove portion 193 in the cooling section 19 to transfer the cold to the heat transfer plate 17, and then flows into the second flow path portion 192. The refrigerant that has flowed into the second flow path portion 192 is guided to the evaporator 4 through the second discharge line 56, Actions and Effects In a case where the magnetic bearing 14 is driven and the shaft portion 11 is magnetically levitated, a large current flows to the magnetic bearing drive substrate 18. In a case where the magnetic bearing 14 is driven, the magnetic bearing drive substrate 18 is a high-heat-generating component.

According to the above configuration, since the magnetic bearing drive substrate 18 is in surface contact with the heat transfer plate 17, the heat generated from the magnetic bearing drive substrate 18 is transferred to the heat transfer plate 17. The heat transferred to the heat transfer plate 17 is transferred to the casing 10 to which the heat transfer plate 17 is attached. Therefore, for example, the beat of the magnetic bearing drive substrate 18 can be transferred more as compared with a case in which the heat transfer plate 17 does not intervene between the magnetic bearing drive substrate 18 and the casing 10. Therefore, for example, the heat generated in the magnetic bearing drive substrate 18 can be smoothly released to the casing 10 without forming the entire casing 10 with a metal having a relatively high thermal conductivity, such as aluminum. As a result, it is possible to suppress an increase in cost occurring when manufacturing the turbo compressor 1.

Further, the groove portion 193 in the cooling section 19 is formed in the heat transfer plate 17, and the refrigerant supplied from the outside flows in the groove portion 193, so that the cold of the refrigerant is transferred to the heat transfer plate 17. Therefore, for example, the magnetic bearing drive substrate 18 can be more stably cooled regardless of the temperature of the casing 10 during operation of the turbo compressor 1, the material of the casing 10, and the like, as compared with a case where the groove portion 193 is not formed in the heat transfer plate 17.

In addition, according to the above configuration, the cooling section 19 that cools the heat transfer plate 17 can be configured by a simple method of forming the flow path portion 190 in the casing 10 and forming the groove portion 193 in the heat transfer plate 17. Therefore, for example, as compared with a case where a device such as a blower capable of air-cooling the heat transfer plate 17 is adopted as the cooling section, it is possible to suppress an increase in the number of components and the maintenance frequency of the turbo compressor 1.

In addition, with the above configuration, since the groove portion 193 in the cooling section 19 extends to meander along the one surface 17*a* of the heat transfer plate 17, for example, the cold of the refrigerant can be more efficiently transferred to the beat transfer plate 17 compared to a case where the groove portion 193 extends without meandering.

In addition, with the above configuration, the magnetic bearing drive substrate 18 is accommodated in the box 16, and the air in the space in the box 16 is replaced with the inert gas in a state where the space in the box 16 is airtightly separated from the outside. Therefore, in a case where the magnetic bearing drive substrate 18 is cooled by the cold of the refrigerant, it is possible to suppress the occurrence of the moisture in the magnetic bearing drive substrate 18 due to the condensation. Therefore, it is possible to suppress the occurrence of an abnormality such as damage in the magnetic bearing drive substrate 18 due to the cooling of the magnetic bearing drive substrate 18 by the cold of the refrigerant. As a result, it is possible to extend the life of the magnetic bearing drive substrate 18. In addition, since the magnetic bearing drive substrate 18 is accommodated in the box 16. the magnetic bearing drive substrate 18 is not exposed to the atmosphere, and for example, heat such as radiation heat or convection heat generated from the magnetic bearing drive substrate 18 can be prevented from affecting other apparatus, In addition, with the above configuration, the displacement sensor substrate 20 that processes the signal detected by the displacement sensor 15 is accommodated in the box 16 together with the magnetic bearing drive substrate 18. Therefore, for example, by detaching the box 16 from the casing 10, it is possible to simultaneously maintain the displacement sensor substrate 20 and the magnetic bearing drive substrate 18. In addition, the displacement sensor substrate 20 may have lower heat resistance than the magnetic bearing drive substrate 18. As a result of cooling the magnetic bearing drive substrate 18 by the heat transfer plate 17 and the cooling section 19, a thermal influence such as radiation heat or convection beat the displacement sensor substrate 20 receives from the magnetic bearing drive substrate 18 is suppressed. As a result, the space (accommodation space R) for installing the displacement sensor substrate 20 can be shared with the magnetic bearing drive substrate 18, and it is possible to suppress the increase in size of the turbo compressor 1.

In addition, according to the above configuration, since the heat transfer plate 17 is formed of the metal material containing aluminum, the heat transfer plate 17 can be easily processed and can be manufactured at a low cost at the same time. In addition, since the heat transfer plate 17 is fitted to the opening 16*a* of the box 16, the beat generated in the magnetic bearing drive substrate 18 can be transferred to the box 16.

In addition, with the above configuration, the refrigerant condensed in the condenser 2 of the centrifugal chiller 100 is guided to the cooling section 19 by the refrigerant supply unit 5. Therefore, for example, it is not necessary to separately provide a device that supplies a refrigerant for cooling to the cooling section 19 in the centrifugal chiller 100. As a result, it is possible to suppress an increase in size of the turbo compressor 1.

In addition, according to the above configuration, the refrigerant from the condenser 2 that flows through the second introduction line 54 of the refrigerant supply unit 5 is put into a gas-liquid two-phase state by being decompressed by the second adjustment valve 55 and is then supplied to the cooling section 19. Therefore, for example, as compared with a case where the refrigerant in the liquid state is simply supplied to the cooling section 19, the temperature of the refrigerant supplied to the cooling section 19 can be lowered, and the amount of the refrigerant to be taken out from the condenser 2 can be reduced. As a result, it is possible to suppress a decrease in a performance coefficient (coefficient of performance (COP)) indicating a ratio of motive power to cooling capacity during operation of the centrifugal chiller 100 while more efficiently transferring the cold to the heat transfer plate 17.

Other Embodiments

The embodiment of the present disclosure has been described in detail above with reference to the wings. However, a specific configuration is not limited to the configuration of the embodiment, and additions, omissions, and substitutions of components and other modifications can be made without departing from the scope of the present disclosure.

In the above-described embodiment, the configuration in which the first adjustment valve 52 is provided in the first introduction line 51 and the second adjustment valve 55 is provided in the second introduction line 54 has been described, bat the present disclosure is not limited to this configuration. For example, the first adjustment valve 52 and the second adjustment valve 55 may be made common to one adjustment valve. In this case, the adjustment valve may be provided on the condenser 2 side with respect to the connecting portion between the first introduction line 51 and the second introduction line 54. Therefore, instead of the configuration in which the refrigerant supply unit 5 includes the first adjustment valve 52 and the second adjustment valve 55, a configuration in which the refrigerant supply unit 5 includes an adjustment valve provided on the condenser 2 side with respect to the connecting portion between the first introduction line 51 and the second introduction line 54 may be adopted.

In addition, the first adjustment valve 52 and the second adjustment valve 55 may be adjusted such that the opening degrees are different from each other. That is, the ratio of the gaseous phase component and the liquid phase component of the refrigerant introduced into the casing 10 through the first introduction line 51 may be different from the ratio of the gaseous phase component and the liquid phase component of the refrigerant introduced into the cooling section 19 through the second introduction line 54.

In addition, in the embodiment described above, the configuration of the groove portion 193 in the cooling section 19 is not limited to the configuration in which the groove portion 193 in the cooling section 19 extends to meander along the one surface 17*a*. The groove portion 193 may be, for example, one recessed portion (large bole) formed to expand along the one surface 17*a*.

In addition, the groove portion 193 in the cooling section 19 may be formed in the casing 10 to be recessed from the outer surface 10*a* of the casing 10 instead of the configuration formed on the heat transfer plate 17.

In addition, in the embodiment described above, the configuration in which the four extension grooves 193*a* are arranged at equal intervals in the up-down direction Dv in a state of being along the one surface 17*a* of the heat transfer plate 17, and the three connection grooves 193*b* connect the end portions of the four extension grooves 193*a* adjacent to each other in the up-down direction Dv, in the axial direction Da to each other in the up-down direction Dv has been described, but the present disclosure is not limited to this configuration. For example, the number of the extension grooves 193*a* may be five or more, and the number of the connection grooves 193*b* may be four or more. In addition, for example, the number of extension grooves 193*a* may be three or less, and the number of connection grooves 193*b* may be two or less.

In addition, in the embodiment described above, the inert gas used for replacing the air in the accommodation space R in the box 16 is not limited to the nitrogen gas. The inert gas may be, for example, argon gas (Ar) or helium gas (He).

In addition, in the embodiment, the configuration of the box 16 is not limited to the configuration in which the box 16 is formed of the metal material containing aluminum. The box 16 may be formed of, for example, a metal material containing iron or a synthetic resin material.

In addition, in the embodiment described above, the configuration in which the one surface 17*a* of the heat transfer plate 17 is directly in surface contact with the outer surface 10*a* of the casing 10 has been described, but the present disclosure is not limited to this configuration. For example, in order to bring the one surface 17*a* of the heat transfer plate 17 into closer contact with the outer surface 10*a* of the casing 10, the one surface 17*a* of the heat transfer plate 17 may be fixed to the outer surface 10*a* in a state of being in close contact with the outer surface 10*a* via a heat dissipating grease of the like.

In addition, in the embodiment described above, the two-stage compression mechanism in the turbo compressor 1 is configured by the impeller 13 having the first impeller 131 and the second impeller 132, but the present disclosure is not limited to this configuration. Since the impeller 13 has only a single impeller, a one-stage (single-stage) compression mechanism may be configured in the turbo compressor 1.

In addition, the terms "parallel", "perpendicular", and "the same" described in the above embodiment refer to a state in which the lines are substantially parallel, perpendicular, and the same, respectively, and slight manufacturing errors, design tolerances, and the like are allowed.

Appendix

For example, the turbo compressor and the centrifugal chiller including the same as described in the embodiments are understood as follows.

(1) A turbo compressor 1 according to a first aspect includes: an impeller 13; a shaft portion 11 that rotates the impeller 13; an electric motor 12 that rotationally drives the shaft portion 11; a casing 10 that accommodates the electric motor 12; a magnetic bearing 14 that supports the shaft portion 11; a heat transfer plate 17 of which one surface 17*a* is attached to an outer surface 10*a* of the casing 10; a magnetic bearing drive substrate 18 that is in surface contact with another surface 17*b* of the heat transfer plate 17 opposite to the one surface 17*a* of the heat transfer plate 17: and a cooling section 19 that, by being supplied with a refrigerant from an outside, transfers cold of the supplied refrigerant to the heat transfer plate 17.

Accordingly, the heat generated from the magnetic bearing drive substrate 18 is transferred to the heat transfer plate 17, and the heat transferred to the heat transfer plate 17 is transferred to the casing 10. Therefore, it is possible to release the heat generated in the magnetic bearing drive substrate 18 to the casing 10 without forming the entire casing 10 with a metal or the like having a high thermal conductivity. Farther, since the cold of the refrigerant is transferred to the heat transfer plate 17, the magnetic bearing drive substrate 18 can be more stably cooled regardless of the temperature of the casing 10 during operation of the turbo compressor 1, the material of the casing 10, and the like.

(2) The turbo compressor 1 according to a second aspect is the turbo compressor 1 of (1), and the cooling section 19 may include a flow path portion 190 that is formed in an outer wall of the casing 10 and through which the refrigerant circulates, and a groove portion 193 that is connected to the flow path portion 190 and is recessed from the one surface 17*a* of the beat transfer plate 17 toward the other surface 17*b* side of the heat transfer plate to form a flow path of the refrigerant together with the outer surface 10*a* of the casing 10.

As a result, the above-described action can be realized with a higher accuracy. In addition, the cooling section 19 that cools the heat transfer plate 17 can be configured by a simple method of forming the flow path portion 190 in the casing 10 and forming the groove portion 193 in the heat transfer plate 17. In addition, for example, as compared with a case where a device such as a blower capable of air-cooling the heat transfer plate 17 is adopted as the cooling section, it is possible to suppress an increase in the number of components and the maintenance frequency of the turbo compressor 1.

(3) The turbo compressor 1 according to a third aspect is the turbo compressor 1 of (2), and the groove portion 193 may extend along the one surface 17*a* of the heat transfer plate 17 in a meandering manner.

Accordingly, the cold of the refrigerant can be transferred to the heat transfer plate 17 more efficiently as compared with a case where the groove portion 193 extends without meandering.

(4) The turbo compressor 1 according to a fourth aspect is the turbo compressor 1 of any of (1) to (3), which may include a box 16 that accommodates the magnetic bearing drive substrate 18 in a state in which an opening 16*a* faces the outer surface 10*a* of the casing 10, the heat transfer plate 17 may fit into the opening 16*a* of the box 16 to form a closed space in which an inside of the box 16 is airtightly separated from an outside, and air in the closed space may be replaced with an inert gas.

Accordingly, in a case where the magnetic bearing drive substrate 18 is cooled by the cold of the refrigerant, it is possible to suppress the occurrence of the moisture in the magnetic bearing drive substrate 18 due to the condensation. In addition, since the magnetic bearing drive substrate 18 is accommodated in the box 16, the magnetic bearing drive substrate 18 is not exposed to the atmosphere, so that it is possible to prevent the heat generated from the magnetic bearing drive substrate 18 from affecting other apparatus.

(5) The turbo compressor 1 according to a fifth aspect is the turbo compressor 1 of (4), which may further include a displacement sensor 15 that is capable of detecting a magnitude of a clearance between the shaft portion 11 and the magnetic bearing 14; and a displacement sensor substrate 20 that is accommodated in the box 16 and processes a signal detected by the displacement sensor 15.

Accordingly, the displacement sensor substrate 20 and the magnetic bearing drive substrate 18 can be maintained at the same time by detaching the box 16 from the casing 10. In addition, as a result of cooling the magnetic bearing drive 18 by the heat transfer plate 17 and the cooling section 19, the influence of the heat received by the displacement sensor substrate 20 from the magnetic bearing drive substrate 18 is suppressed, so that the space for installing the displacement sensor substrate 20 can be shared with the magnetic bearing drive substrate 18.

(6) The turbo compressor 1 according to a sixth aspect is the turbo compressor 1 of any of (1) to (5), and the heat transfer plate 17 may be formed of a metal material containing aluminum.

Accordingly, the heat transfer plate 17 can be easily processed, and can be manufactured at a low cost at the same time.

(7) A centrifugal chiller 100 according to a seventh aspect includes the turbo compressor 1 of any of (1) to (6); a condenser 2 that condenses a refrigerant discharged from the turbo compressor 1; an expansion valve 3 that adiabatically expands the refrigerant condensed by the condenser 2; an evaporator 4 that evaporates the refrigerant adiabatically expanded by the expansion valve 3; and a refrigerant supply unit 5 that is capable of introducing the refrigerant condensed by the condenser 2 to the cooling section 19.

As a result, the refrigerant condensed by the condenser 2 is guided to the cooling section 19 by the refrigerant supply unit S. Therefore, it is not necessary to separately provide a device that supplies a refrigerant for cooling to the cooling section 19 to the centrifugal chiller 100.

(8) The centrifugal chiller 100 according to an eight aspect is the centrifugal chiller 100 of (7), and the refrigerant supply unit 5 may include an introduction line that introduces the refrigerant to the cooling section 19, and an adjustment valve that is provided in the introduction line and decompresses the refrigerant flowing in the introduction line to put the refrigerant flowing toward the cooling section 19 in a gas-liquid two-phase state.

Accordingly, it is possible to decrease the temperature of the refrigerant supplied to the cooling section 19 and to suppress the amount of the refrigerant to be taken out from the condenser 2 as compared with a case where the refrigerant in the liquid state is supplied to the cooling section 19.

INDUSTRIAL APPLICABILITY

According to the present disclosure, it is possible to provide a turbo compressor and a centrifugal chiller capable of stably cooling a magnetic bearing drive substrate while suppressing an increase in cost.

REFERENCE SIGNS LIST

1: turbo compressor
2: condenser
3: expansion valve
4: evaporator
5: refrigerant supply unit
6: condenser line
7: connection line
8: evaporator line
10: casing
10*a*: outer surface
11: shaft portion
12: electric motor
12*a*: motor rotor
12*b*: motor stator
13: impeller
14: magnetic bearing
14*a*: first magnetic bearing
14*b*: second magnetic bearing
15: displacement sensor
15*a*: first displacement sensor
15*b*: second displacement sensor
16: box
16*a*: opening
16*b*: inner surface
17: heat transfer plate
17*a*: one surface
17*b*: other surface
18: magnetic bearing drive substrate
18*a*: abutting surface
18*b*: mounting surface
19: cooling section
20: displacement sensor substrate
21, 41: heat transfer pipe
51: first introduction line
52: first adjustment valve
53: first discharge line
54: second introduction line
55: second adjustment valve
56: second discharge line
100: centrifugal chiller
131: first impeller
131*a*: first blade group
131*b*: first impeller casing
132: second impeller
132*a*: second blade group
132*b*: second impeller casing
133: interstage line
190: flow path portion
191: first flow path portion
192: second flow path portion.
193: groove portion
193*a*: extension groove
193*b*: connection groove
B: fastening member
Da: axial direction
Dal: other side
Dar: one side
De: circuinferential direction
Dv: up-down direction
Dvd: lower side
Dvu: upper side
O: central axis
R: accommodation space

The invention claimed is:

1. A turbo compressor comprising:
an impeller;
a shaft portion that rotates the impeller;
an electric motor that rotationally drives the shaft portion;
a casing that accommodates the electric motor;
a magnetic bearing that supports the shaft portion;
a heat transfer plate of which one surface is attached to an outer surface of the casing;
a magnetic bearing drive substrate that is in surface contact with another surface of the heat transfer plate opposite to the one surface of the heat transfer plate;
a cooling section that, by being supplied with a refrigerant from an outside, transfers cold of the supplied refrigerant to the heat transfer plate; and
a box that accommodates the magnetic bearing drive substrate in a state in which an opening faces the outer surface of the casing,
wherein the heat transfer plate fits into the opening of the box to form a closed space in which an inside of the box is airtightly separated from an outside, and
air in the closed space is replaced with an inert gas.

2. The turbo compressor according to claim 1, wherein the cooling section includes a flow path portion that is formed in an outer wall of the casing and through which the refrigerant circulates, and a groove portion that is connected to the flow path portion and is recessed from the one surface of the heat transfer plate toward the other surface side of the heat transfer plate to form a flow path of the refrigerant together with the outer surface of the casing.

3. The turbo compressor according to claim 2, wherein the groove portion extends along the one surface of the heat transfer plate in a meandering manner.

4. The turbo compressor according to claim 1, further comprising:

a displacement sensor that is capable of detecting a magnitude of a clearance between the shaft portion and the magnetic bearing; and a displacement sensor substrate that is accommodated in the box and processes a signal detected by the displacement sensor.

5. The turbo compressor according to claim 1, wherein the heat transfer plate is formed of a metal material containing aluminum.

6. A centrifugal chiller comprising:

the turbo compressor according to claim 1;

a condenser that condenses a refrigerant discharged from the turbo compressor;

an expansion valve that adiabatically expands the refrigerant condensed by the condenser;

an evaporator that evaporates the refrigerant adiabatically expanded by the expansion valve; and a refrigerant supply unit that is capable of introducing the refrigerant condensed by the condenser to the cooling section.

7. The centrifugal chiller according to claim 6, wherein the refrigerant supply unit includes an introduction line that introduces the refrigerant to the cooling section, and an adjustment valve that is provided in the introduction line and decompresses the refrigerant flowing in the introduction line to put the refrigerant flowing toward the cooling section in a gas-liquid two-phase state.

* * * * *